US006648418B2

(12) United States Patent
Bergeron et al.

(10) Patent No.: US 6,648,418 B2
(45) Date of Patent: Nov. 18, 2003

(54) COLLAPSIBLE FOOTREST ASSEMBLY FOR A GLIDING OTTOMAN

(75) Inventors: Sylvain Bergeron, Rock Forest (CA); David Stephen Hoffman, High Point, NC (US); Marcus Lindsay Murphy, Lexington, NC (US)

(73) Assignee: Shermag Inc., Sherbrooke (CA)

( * ) Notice: Subject to any disclaimer, the term of this patent is extended or adjusted under 35 U.S.C. 154(b) by 40 days.

(21) Appl. No.: 09/927,228

(22) Filed: Aug. 10, 2001

(65) Prior Publication Data

US 2003/0038522 A1 Feb. 27, 2003

(51) Int. Cl.[7] ..... A47C 1/02

(52) U.S. Cl. ..... 297/423.43; 297/423.12; 297/423.21

(58) Field of Search ..... 297/68, 69, 88, 297/89, 258.1, 261.1, 259.1, 273, 281, 269.1, 270.1, 423.19, 423.2, 423.21, 423.22, 423.25, 84, 423.43, 423.38

(56) References Cited

U.S. PATENT DOCUMENTS

| | | | | | |
|---|---|---|---|---|---|
| 815,046 | A | | 3/1906 | Sherman | |
| 2,480,812 | A | * | 8/1949 | Muller | |
| 2,604,146 | A | * | 7/1952 | Martin | |
| RE24,128 | E | | 3/1956 | Creveling et al. | 155/45 |
| 2,770,293 | A | | 11/1956 | Eichorst | 155/169 |
| 2,822,861 | A | | 2/1958 | Parent | 155/165 |
| 2,850,081 | A | | 9/1958 | Dillon | 155/169 |
| 3,220,772 | A | | 11/1965 | Lucky | 297/423 |
| 3,295,885 | A | * | 1/1967 | Barksdale | |
| 3,794,381 | A | * | 2/1974 | Caldemeyer | |
| 4,212,495 | A | * | 7/1980 | Gall | |
| 4,427,234 | A | | 1/1984 | Peters | 297/439 |
| 4,470,634 | A | * | 9/1984 | Delius et al. | |
| 5,013,084 | A | * | 5/1991 | May | |
| 5,558,397 | A | * | 9/1996 | Chang | |
| 5,593,212 | A | | 1/1997 | Praria et al. | 297/423.44 |
| 5,795,021 | A | * | 8/1998 | Rogers | |
| 6,059,367 | A | * | 5/2000 | Rogers | |

* cited by examiner

*Primary Examiner*—Peter M. Cuomo
*Assistant Examiner*—Stephen Vu
(74) *Attorney, Agent, or Firm*—Collard & Roe, P.C.

(57) ABSTRACT

A collapsible footrest assembly for a gliding ottoman with a top structure gliding upon a base. A pair of parallel, elongated slides are movably mounted under the top structure between upper and lower positions with respect to the top structure. A footrest is slidably and pivotally mounted between the slides for sliding operation between a slide-in position wherein the footrest extends and is supported between the slides and a slide-out position wherein the footrest is drawn out and pivoted down in front of the slides. The slide arrangement is detachably hooked under the top structure in the upper position, and is detachably locked with the base when it is in the lower position to prevent the ottoman from gliding when the footrest is in use.

11 Claims, 4 Drawing Sheets

COLLAPSIBLE FOOTREST ASSEMBLY FOR A GLIDING OTTOMAN

FIELD OF THE INVENTION

The present invention relates to a collapsible footrest assembly for a gliding ottoman and a gliding ottoman equipped with such a collapsible footrest assembly.

BACKGROUND

Gliding ottomans have become popular in the past decade, especially in conjunction with the new models of gliding rockers now available on the market. Lately, models of ottomans with a footrest which collapses inside the ottoman structure have been proposed. However, the footrest mechanisms are generally rudimentary and often unsafe.

One known model has a footrest which is mounted between slides attached to the base. The footrest is positioned for use by sliding it out and lowering its front part against the ground. It is set back in the ottoman by lifting its front part and sliding it in. The footrest is provided with a rear key member which pivots with the footrest and engages with a locking member under the top gliding structure of the ottoman to prevent it from gliding when the footrest is slid out and pivoted down for use. The locking is effective only when the footrest is completely drawn out and rests on the ground. Also, sufficient pressure against the top gliding structure in the gliding direction may cause the footrest to lift and the key member to undesirably disengage from the locking member.

U.S. Pat. No. 815,046 (Sherman), U.S. Pat. No. Re. 24,128 (Creveling et al.), U.S. Pat. No. 2,770,293 (Eichorst), U.S. Pat. No. 2,822,861 (Parent), U.S. Pat. No. 2,850,081 (Dillon), U.S. Pat. No. 3,220,772 (Lucky), U.S. Pat. No. 4,427,234 (Peters), and U.S. Pat. No. 5,593,212 (Praria et al.), show different kinds of ottomans, stools, footrests or similar pieces of furniture, and illustrate the state of the art.

SUMMARY

An object of the invention is to provide a collapsible footrest assembly for a gliding ottoman which has an improved design over the prior art, yet which remains simple in construction and highly cost-competitive while being reliable and efficient.

Another object of the invention is to provide such a footrest assembly which can be used to lock the gliding ottoman without drawing out the footrest.

According to the present invention, there is provided a collapsible footrest assembly for a gliding ottoman with a top structure gliding upon a base, comprising:

a slide arrangement having opposite front and rear ends between which a pair of parallel, elongated slides extend;

mounting means for movably mounting the slide arrangement under the top structure of the gliding ottoman between upper and lower positions with respect to the top structure of the gliding ottoman;

a footrest slidably and pivotally mounted between the slides for sliding operation between a slide-in position wherein the footrest extends and is supported between the slides and a slide-out position wherein the footrest is drawn out and pivoted down in front of the slides;

hooking means for detachably hooking the slide arrangement under the top structure in the upper position; and locking means for detachably locking the slide arrangement with the base when the slide arrangement is in the lower position.

According to the present invention, there is also provided a gliding ottoman equipped with a collapsible footrest assembly as described above.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 1:
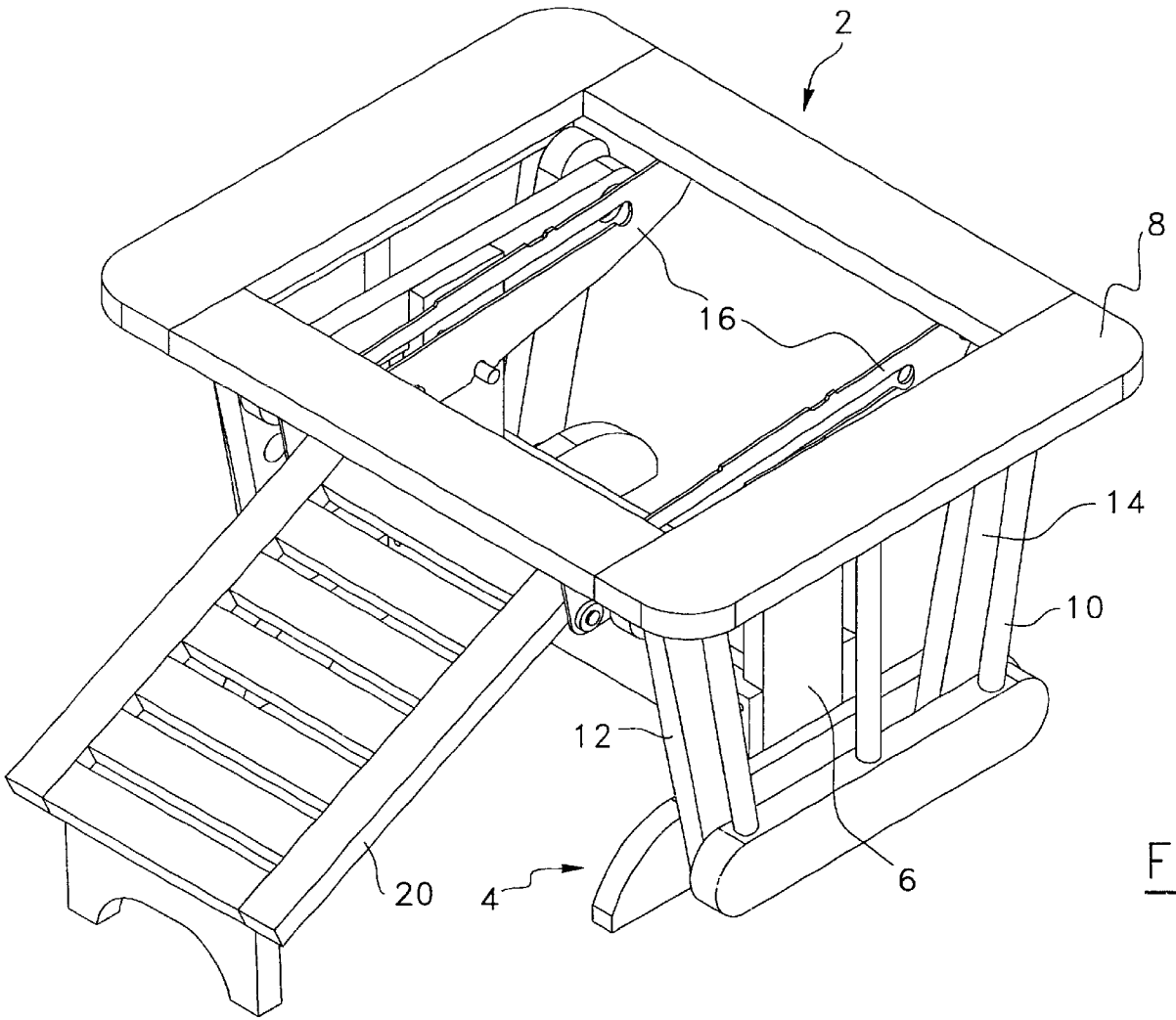
FIG. 1 is a perspective view of a gliding ottoman equipped with a collapsible footrest assembly according to the present invention.

Referring to FIG. 1, there is shown a gliding ottoman equipped with a collapsible footrest assembly according to the present invention. The ottoman has a top structure 2 gliding upon a base 4. The base 4 has a pair of opposite, parallel upright legs 6 having T-shaped upper ends. The top structure 2 has an upper frame 8 extending over the base 4, and a pair of opposite, parallel side members 10 downwardly projecting from the frame and extending on outer sides of the legs 6 of the base 4 and having lower ends provided with linkage members 12, 14 pivotally suspended to the T-shaped upper ends of the legs 6 of the base 4 respectively.

The collapsible footrest assembly has a slide arrangement having opposite front and rear ends between which a pair of parallel, elongated slides 16 extend.

Figure 2:
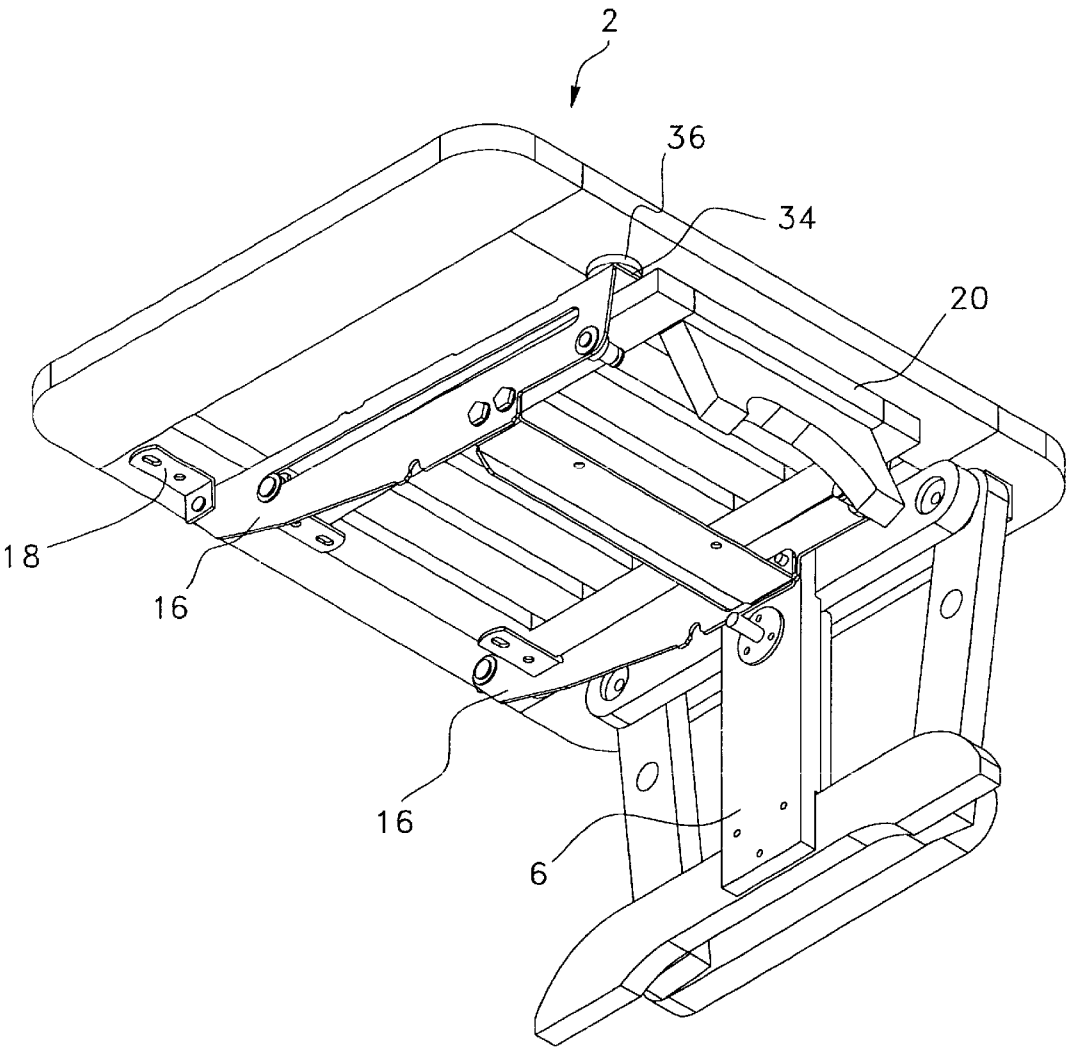
FIG. 2 is a partial perspective view of a gliding ottoman equipped with a collapsible footrest assembly according to the present invention.

Referring to FIG. 2, the slide arrangement is movably mounted under the top structure 2 so that it can be moved between upper and lower positions with respect to the top structure 2 of the gliding ottoman (as depicted in FIGS. 1 and 2 respectively). The mounting of the slide arrangement can be embodied in many ways. Preferably, a pair of brackets 18 attached under the top structure 2 and pivotally receiving rear ends of the slides 16 are used for this purpose. Hence, the rear end of the slide arrangement is pivotally mounted under the top structure 2 of the gliding ottoman, and the front end of the slide arrangement can be raised and lowered to the upper and lower positions respectively. The slide arrangement extends parallel or so with the top structure 2 of the gliding ottoman in the upper position and is pivotally lowered about the rear end of the slide arrangement to a forwardly slanted position in the lower position. Different kinds of mounting arrangements can also be implemented, for example a set of folding arms (not shown in the Figures) suspending the slide arrangement under the top structure 2 of the ottoman. Such a mounting arrangement could possibly be useful for facilitating adaptation of the footrest assembly to various models of ottomans.

Referring to FIG. 1, a footrest 20 is slidably and pivotally mounted between the slides 16 for sliding operation between a slide-in position wherein the footrest 20 extends and is supported between the slides 16 (as depicted in FIG. 2) and a slide-out position wherein the footrest 20 is drawn out and pivoted down in front of the slides 16 (as depicted in FIG. 1). The mounting of the footrest 20 can be made in different ways.

Figure 3:
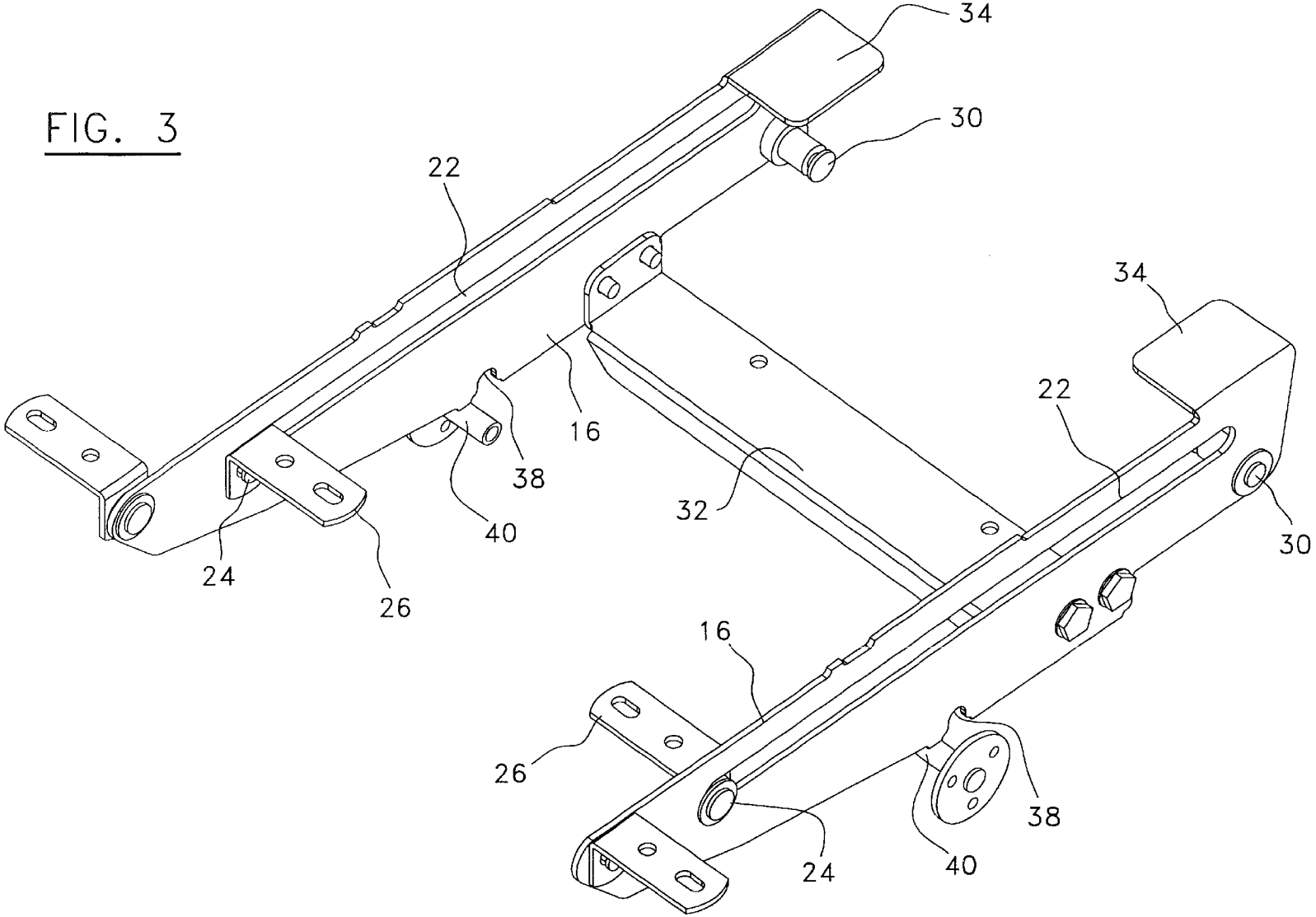
FIGS. 3 and 4 are perspective views of the slide arrangement and associated parts of a collapsible footrest assembly according to the present invention, in upper/unlocked and lower/locked positions respectively.
Figure 4:
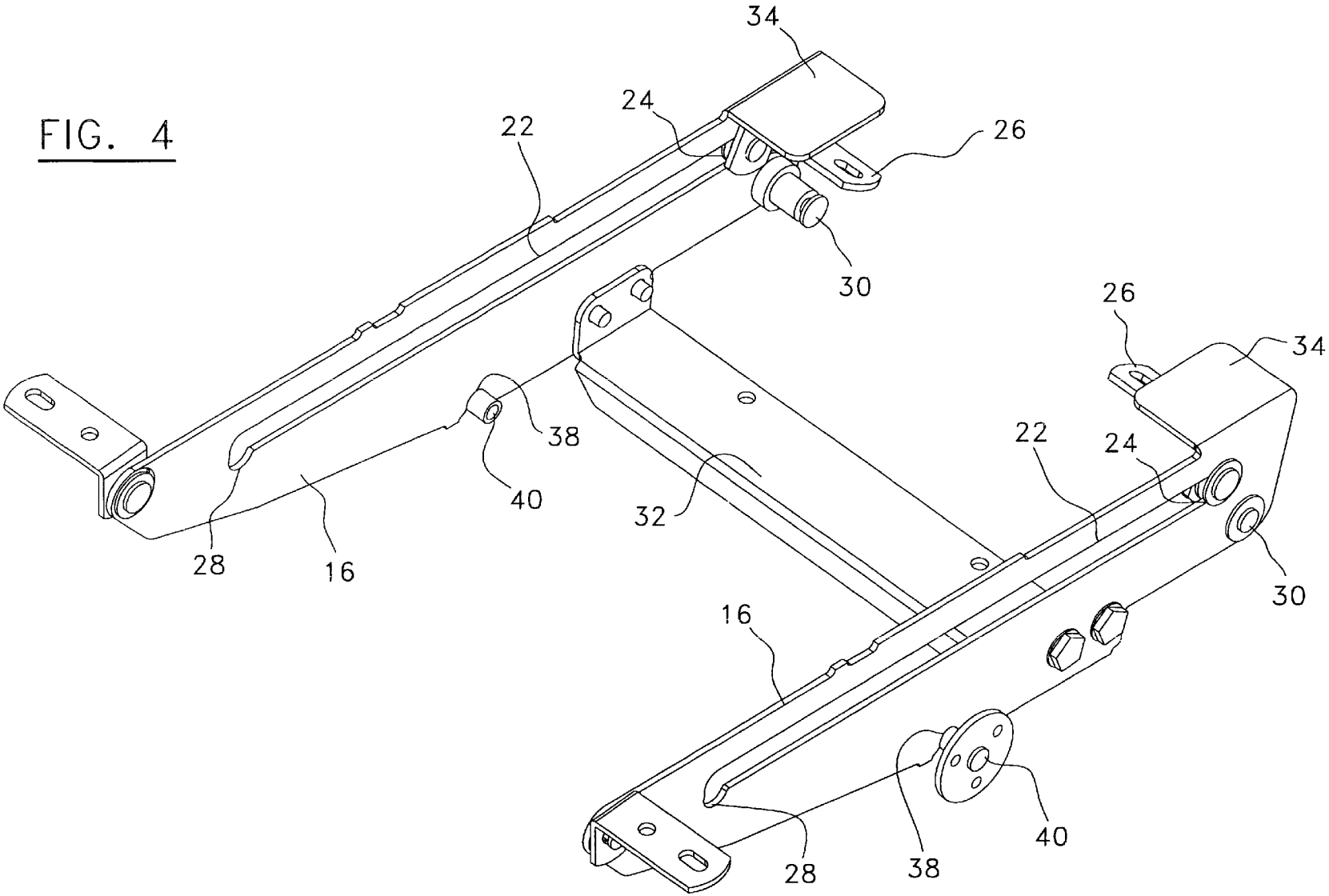

Referring to FIGS. 3 and 4, preferably, the slides 16 have longitudinal slots 22, and the footrest 20 (shown in FIG. 1) has a rear portion provided with opposite side projecting pins 24 extending in slideable and pivotable engagement with the slots 22, respectively. The pins 24 may, as illustrated, conveniently be provided by mounting brackets 26 attached to the footrest 20. They can be provided otherwise, e.g. as part of the footrest 20 if desired (not shown).

The slots 22 preferably have depressions 28 as best shown in FIG. 4, near their rear ends into which the pins 24 fall and are held back when the footrest 20 is in the slide-in position and the slide arrangement is in the upper position. Such depressions 28 or equivalent means to prevent the footrest 20 from sliding freely can be omitted if the slides 16 are mounted or the slots 22 arranged so that they lay in a backwardly slanted direction when the footrest 20 is not used (not shown).

The slides 16 have front ends provided with facing side projecting rollers 30 receiving and upholding the footrest 20 when it is in the slide-in position. Other kinds of supports can be used depending on the construction and configuration of the slides 16 and the footrest 20.

A transverse straightening member 32 extending between the slides 16 at a predetermined distance from their rear ends is preferably used to prevent the slides 16 from moving sideways with respect to each other.

Referring to FIG. 2, a hooking arrangement is provided to detachably hook the slide arrangement under the top structure in the upper position. The hooking arrangement is preferably formed of a pair of magnet attractable surfaces 34 (as best shown in FIGS. 3 and 4) on top portions of the slides 16 at their front end, and a pair of magnets 36 attached to hooking underside portions of the top structure 2. The front end of the slides 16 thus magnetically hooks to the corresponding hooking underside portion of the top structure 2 when the slide arrangement is in the upper position. The slides are preferably in metal, thereby providing the magnet attractable surfaces 34 without additional components. Otherwise, e.g. for slides made in plastic or wood, the surfaces 34 can be provided by affixing small plates (not shown) made of metal or any other magnet attractable material to the slides 16. Mutually attractive magnets can be used both under the top structure 2 and the slides 16 for stronger hooking if desired. The positions of the magnets 36 and the magnet attractable surfaces 34 can be interchanged and other hooking mechanisms can be used if desired.

Referring to FIGS. 3 and 4, the footrest assembly is provided with a locking mechanism to prevent the ottoman from gliding when the footrest 20 (shown in FIGS. 1 and 2) is used and the slide arrangement is in the lower position. The locking mechanism can be conveniently made of a pair of upward notches 38 made in lower edges of center portions of the slides, and a pair of facing, side projecting pins 40 attached to locking side portions of the base 4, e.g. inner sides of the legs 6, on outer opposite sides of the slides 16 as best shown in FIGS. 1 and 2. The side projecting pins 40 engage into the notches 38 when the slide assembly is in the lower position, as depicted in FIG. 4. The positions of the notches 38 and the pins 40 can be interchanged and other locking mechanisms can be used depending on the model of the ottoman.

The operation of the collapsible footrest assembly according to the invention is very easy and especially safe.

FIGS. 2 and 3 show the footrest assembly and parts of it in collapsed position. To use the footrest 20, the user simply lowers the front end of the slides 16 to lock them with the base 4 against gliding of the top structure 2 by engagement of the pins 40 in the notches 38, and slides the footrest 20 out of the ottoman. FIGS. 1 and 4 show the footrest assembly and parts of it in slide-out position. The footrest 20 is collapsed by performing the reverse operations, i.e. sliding the footrest 20 under the top structure and lifting the front end of the slides 16 to hook them to the magnets 36. The footrest 20 remains in place due to the back depressions 28 in the slots 22 and the top structure 2 is free to glide upon the base 4 as usual. The footrest assembly can be used to simply lock the ottoman against gliding by lowering the slides 16 without drawing out the footrest 20. Such a feature makes it more safe with regard to children to prevent them from having their fingers caught in the gliding ottoman.

It should be noted that the collapsible footrest assembly according to the invention can be used with other pieces of gliding furniture having a structure similar to the ottoman hereinabove referred to, e.g. a glider rocker.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A collapsible footrest assembly for a gliding ottoman with a top structure gliding upon a base, comprising:

a slide arrangement having opposite front and rear ends between which a pair of parallel, elongated slides extend;

mounting means for movably mounting the slide arrangement under the top structure of the gliding ottoman between upper and lower positions with respect to the top structure of the gliding ottoman;

a footrest slidably and pivotally mounted between the slides for sliding operation between a slide-in position wherein the footrest extends and is supported between the slides and a slide-out position wherein the footrest is drawn out and pivoted down in front of the slides;

hooking means for detachably hooking the slide arrangement under the top structure in the upper position; and locking means for detachably locking the slide arrangement with the base when the slide arrangement is in the lower position.

2. The collapsible footrest assembly according to claim 1, wherein:

the mounting means comprises a pivot means for pivotally mounting the rear end of the slide arrangement under the top structure of the gliding ottoman, the slide arrangement extending substantially parallel with the top structure of the gliding ottoman in the upper position and being pivotally lowered about the rear end of the slide arrangement to a forwardly slanted position in the lower position.

3. The collapsible footrest assembly according to claim 2, wherein the pivot means comprises a pair of brackets attachable under the top structure and pivotally receiving rear ends of the slides.

4. The collapsible footrest assembly according to claim 1, wherein the slides have longitudinal slots, and the footrest has a rear portion provided with opposite side projecting pins extending in slideable and pivotable engagement with the slots, respectively.

5. The collapsible footrest assembly according to claim 4, wherein the slides have front ends provided with facing side projecting rollers receiving and upholding the footrest when the footrest is in the slide-in position.

6. The collapsible footrest assembly according to claim 1, wherein the slide arrangement has a transverse straightening member extending between the slides at a predetermined distance from rear ends thereof.

7. A collapsible footrest assembly for a gliding ottoman with a top structure gliding upon a base comprising:

a slide arrangement having opposite front and rear ends between which a pair of parallel, elongated sides extend;

mounting means for movably mounting the slide arrangement under the top structure of the gliding ottoman between upper and lower positions with respect to the top structure of the gliding ottoman wherein said mounting means comprises a pivot means for pivotally mounting the rear end of the slide arrangement under the top structure of the gliding ottoman, and wherein said slide arrangement extends substantially parallel with the top structure of the gliding ottoman in the upper position and is pivotally lowered about the rear end of the slide arrangement to a forwardly slanted position in the lower position;

a footrest slidably and pivotally mounted between the slides for sliding operation between a slide-in poistion wherein the footrest extends and is supported between the slides and a slide-out position wherein the footrest is drawn out and pivoted down in front of the slides;

hooking means for detachably locking the slide arrangement with the base when the slide arrangement is in the lower position wherein said hooking means comprises a magnet arrangement distributed between the front end of said slide arrangement and a corresponding hooking underside portion of the top structure extending over the front end of said slide arrangement, so that the front end of the slide arrangement magnetically hooks to the corresponding hooking underside portion of the top structure when the slide arrangement is in the upper position; and locking means for detachably locking the slide arrangement with the base when the slide arrangement is in the lower position.

8. The collapsible footrest assembly according to claim 7, wherein the magnet arrangement comprises a pair of magnet attractable surfaces on top portions of the slides at the front end of the slide arrangement, and a pair of magnets attachable to the hooking underside portions of the top structure.

9. A collapsible footrest assembly for a gliding ottoman with a top structure gliding upon a base comprising:

a slide arrangement having opposite front and rear ends between which a pair of parallels elongated sides extend wherein said slide arrangement has longitudinal slots;

mounting means for movably mounting the slide arrangement under the top structure of the gliding ottoman between upper and lower positions with respect to the top structure of the gliding ottoman;

a footrest slidably and pivotally mounted between the slides for sliding operation between a slide-in position wherein the footrest extends and is supported between the slides and a slide-out position wherein the footrest is drawn out and pivoted down in front of the slides and the footrest has a rear portion provided with opposite side projecting pins extending in slidable and pivotable engagement with said slots of said slides, respectively;

hooking means for detachably locking the slide arrangement with the base when the slide arrangement is in the lower position; and locking means for detachably locking the slide arrangement with the base when the slide arrangement is in the lower position.

10. A collapsible footrest assembly for a gliding ottoman with a top structure gliding upon a base comprising:

a slide arrangement having opposite front and rear ends between which a pair of parallel, elongated sides extend;

mounting means for movably mounting the slide arrangement under the top structure of the gliding ottoman between upper and lower positions with respect to the top structure of the gliding ottoman;

a footrest slidably and pivotally mounted between the slides for sliding operation between a poistion wherein the footrest extends and is supported between the slides and a slide-out position wherein the footrest is drawn out and pivoted down in front of the slides;

hooking means for detachably locking the slide arrangement with the base when the slide arrangement is in the lower position; and locking means for detachably locking the slide arrangement with the base when the slide arrangement is in the lower position wherein said locking means comprises a pin and a notch interlocking arrangement distributed between the slides and corresponding locking side portions of the base extending aside the slides when the slide arrangement is in the lower position, so that the slides lock with the base against gliding of the top structure on the base.

11. The collapsible footrest assembly according to claim 10, wherein the pin and notch interlocking arrangement comprises a pair of upward notches made in lower edges of center portions of the slides, and a pair of facing side projecting pins attachable to the locking side portions of the base on outer opposite sides of the slides, the side projecting pins engaging into the notches when the slide assembly is in the lower position.

* * * * *